United States Patent [19]

Rossini et al.

[11] Patent Number: 5,017,827

[45] Date of Patent: May 21, 1991

[54] COMPACTLY BUILT ELECTRON TUBE AND FABRICATION METHOD THEREOF

[75] Inventors: Umberto Rossini, Saint Egreve; Pierre Simonin, Meylan; Christine Tremblay, Voreppe, all of France

[73] Assignee: Thomson-CSF, Puteaux, France

[21] Appl. No.: 425,000

[22] Filed: Oct. 23, 1989

[30] Foreign Application Priority Data

Oct. 25, 1988 [FR] France ..... 88 13914

[51] Int. Cl.[5] ..... H01J 29/82; H01J 9/18; H01J 1/88

[52] U.S. Cl. ..... 313/268; 313/289; 313/456; 445/34; 445/45

[58] Field of Search ..... 313/444, 268, 289, 477 R, 313/417, 456, 451; 445/34, 45

[56] References Cited

U.S. PATENT DOCUMENTS

| | | | |
|---|---|---|---|
| 2,967,260 | 1/1961 | Eitel | 313/456 X |
| 2,977,494 | 3/1961 | Johnstone et al. | 313/289 X |
| 3,204,140 | 8/1965 | Kearns | 313/268 |
| 3,383,537 | 5/1968 | Marshall | 313/444 |
| 3,979,634 | 9/1976 | Jaillet et al. | 313/456 X |
| 4,039,877 | 8/1977 | Wimmer | 313/383 X |
| 4,713,520 | 12/1987 | Van Nice et al. | 445/45 X |

FOREIGN PATENT DOCUMENTS

| | | | |
|---|---|---|---|
| 0048510 | 3/1982 | European Pat. Off. . | |
| 0241726 | 10/1987 | European Pat. Off. . | |
| 58-739 | 4/1984 | Japan | 445/34 |

*Primary Examiner*—Palmer C. DeMeo

*Attorney, Agent, or Firm*—Oblon, Spivak, McClelland, Maier & Neustadt

[57] ABSTRACT

The disclosure concerns electron tubes. A tube such as a cathode-ray tube consists of several parts, namely the stem, the neck, the cone and the screen of the front face. To build a tube such as this more compactly while, at the same time, improving the quality of the fabrication, a new construction of the neck is proposed. In the prior art, the neck is a glass tube to which there is soldered a glass stem through which pass the connection terminals towards the various electrodes, internal to the tube. Here, the neck is built in the form of a stack of alternating metallic rings and ceramic rings. The metallic rings are used for the supporting of and electrical connection to the internal electrodes. The ceramic rings are used to insulate the metallic rings. The brazings between metallic rings and ceramic rings provide for vacuum tightness. The base of the tube is a ceramic washer without drillings other than lateral ones for the connections to pass through. The connections are made chiefly around the neck on the metallic rings.

9 Claims, 2 Drawing Sheets

COMPACTLY BUILT ELECTRON TUBE AND FABRICATION METHOD THEREOF

BACKGROUND OF THE INVENTION

1. Field of the Invention

The invention concerns electron tubes.

For a clear understanding of the invention, we shall give a more precise description of its application to a cathode-ray tube, namely a tube comprising, firstly, an electron gun producing an electron beam and, secondly, a luminescent screen reacting to the impact of the beam to produce a light image.

2. Description of the Prior Art

A cathode-ray tube is formed, generally speaking, by a glass bulb in which the different elements (and notably the different electrodes) enabling the operation of the tube are placed. A high vacuum is then set up in the bulb.

The glass bulb is formed by four different main parts which are respectively:

the screen or front face of the tube, forming the luminescent screen on to which the electron beam is directed;

the cone, in which the electron beam moves; the wide part of the cone ends on the front face; the narrow part is connected to the neck of the bulb;

The neck, which is a glass tube with a small diameter as compared with the dimensions of the front face; in the cone, there are placed chiefly the electron gun with the beam focusing electrodes; coils for the angular deflection of the beam are placed around the neck;

the stem which, in practice, is an end glass plate enclosing the neck on the side opposite the tube; this plate is crossed by connection terminals enabling electrical connection between each of the electrodes internal to the tube and the exterior; the crossings are vacuum tight; the stem generally comprises a pip to set up the vacuum by pumping.

The stem, after the assembly of the internal elements of the tube, is soldered to the neck by a glass/glass soldering operation, i.e. by melting the glass of the stem and the glass of the neck, using a torch.

In the prior art, the electrodes of the electron gun are supported by metallic points embedded in glass rods extending, in the neck, to its periphery, in a direction parallel to the axis of the neck. The metallic points are embedded in the glass rods by prior heating of these rods to a temperature which gives the glass a paste-like consistency. These points are, moreover, soldered to the periphery of the electrodes which they have to support.

The different potentials needed for the working of the electrodes are conveyed either by the connection terminals of the stem or, for certain electrodes, by springs in indirect contact (through a graphite layer deposited on the internal wall of the neck and the cone) with the front face of the bulb.

Other springs are designed to center the gun in the neck, to hold it and to make it resistant to vibrations.

On the left-hand side of FIG. 1, a standard cathode-ray tube assembly of this type is shown. Only the stem (at the bottom of the figure) and the neck are shown. The cone and the front face are not shown. They would extend towards the top of the figure.

The stem is designated by the reference 10, the neck by the reference 12, the solder between the stem and the neck by 14, connection terminals going through the stem by 16, internal glass rods by 18, electrode supporting points by 20, electrodes by G1, G2, G3, G4 and the pumping pip by 22.

It will be noted that the right-hand part of FIG. 1 represents not the prior art but the invention.

Besides, elements external to the tube, such as the electromagnetic coils used to deflect the electron beam, have not been shown. These coils surround the neck so as to act on the trajectory of the electrons between the electron gun and the end of the neck.

It is an aim of the invention to make electron tubes that are less bulky widthwise and/or lengthwise.

Another aim is to make tubes in which the energy consumption of the deflection coils is reduced to the minimum.

Another aim of the invention is to maximize the diameter of the electrostatic focusing electrodes in the allocated space within the neck, in order to reduce spherical aberrations to the minimum.

Another aim is to increase the general sturdiness of the tube.

Yet another aim is to minimize the risks of production of solid particles inside the tube during fabrication or during operation, as these particles could damage the quality of operation of the tube (the quality of the image for example).

Finally, an aim of the invention is to prevent any chemical pollution of certain sensitive elements such as the screen of the tube or the cathode of the electron gun by products such as water vapor or other elements resulting from combustion in a torch used to solder or heat certain parts of the tube.

SUMMARY OF THE INVENTION

To achieve these aims, the invention proposes an electron tube comprising a neck, at least one part of which is formed by a stack of supporting metallic rings and ceramic rings, the metallic rings being used for the supporting of and the electrical connection to the different internal electrodes of the tube, the ceramic rings being used for the electrical insulation and physical separation of the metallic rings. The metallic rings are brazed to the ceramic rings to provide vacuum tightness, and they have a part internal to the tube used as a support to an electrode (distinct from the ring) and an external part to be used for the outgoing electrical connection.

The electrodes are soldered by a metal-metal soldering (pollution-free electrical or laser soldering) to the metallic rings which are used for support and connection. This soldering takes place after the ceramic-metal brazings which, for their part, are a source of pollution. In this way the cathode (notably) is not affected by the brazing operations.

The tube base is preferably formed by a ceramic washer, and has no drillings in the axis of the tube to provide the electrical connection with the electrodes of the tube. It has only lateral drillings to let through the cathode connections and the heating filament of the cathode; the external connections with the other electrodes are made directly at the periphery of the neck by contact with the metallic rings.

Preferably, to hold and connect an electrode in the form of a cylindrical ring, it is planned that one of the supporting metallic rings will have, firstly, a cylindrical part coaxial with the axis of the neck, the internal surface of which is soldered to the cylindrical external surface of the electrode and, secondly, a plane annular part extending in a plane that is perpendicular to the axis of the neck and concentric with it, said plane annular part extending from the axial cylindrical part up to the exterior of the neck, and being brazed to a plane annular surface of a ceramic ring.

This arrangement notably makes it more easy to adjust the position of the electrodes when the tube is being fabricated. Depending on need, such an electrode may be slid in the direction of the axis of the tube to be soldered at a place which may vary as a function of the performance characteristics required of the tube.

In one exemplary embodiment, the stack of rings is as follows: the base of the tube is a bowl-shaped ceramic washer, the concavity of which is pointed towards the front of the tube, and the bottom of which forms the rear end of the tube. A first metallic ring, which supports a first grid of the tube and is used for its outgoing connection, is brazed to the edges of the ceramic washer. Another ceramic ring insulates the first metallic ring from a second one used for the support and connection of a second (acceleration) grid of the tube. Another ceramic ring is used for the insulation between the second metallic ring and a third metallic ring used for the support and for the outgoing connection of a third (focusing) grid of the tube. Finally, the third metallic ring is soldered by a glass-metal solder to the glass parts of the tube. The pumping is done by a pip in a glass part of the tube (on the cone).

The entire neck, thus made by the superimposition of metallic rings and ceramic rings, is vacuum tight due to:

the ceramic-metal brazings between the rings;

the metal-metal solderings between the different metallic parts when a ring is made by assembling several metallic parts;

the glass-metal solderings that remain, i.e. practically only at the junction between the last metallic ring of the stack and the glass parts of the tube.

The fabrication method comprises the following operations: the making of a stack of ceramic rings brazed to metallic rings interposed between these ceramic rings, then the electrical or laser soldering of the electrodes to the rings of the stack.

Preferably, the method is implemented in the following operations:

the making of a first set comprising at least one ceramic ring brazed to a metallic ring;

the making of a second set comprising a stack of ceramic rings brazed to metallic rings interposed between these ceramic rings;

the mounting of a cathode in the first set, and the soldering of at least one grid, by electrical or laser soldering, to a metallic ring of the second set;

the soldering, by electrical or laser soldering, of a metallic ring of the first set to a metallic ring of the second set so as to achieve a vacuum-tight, fixed joining of the two sets respectively bearing the cathode and the grid.

BRIEF DESCRIPTION OF THE DRAWINGS

Other features and advantages of the invention will appear from the following detailed description, made with reference to the appended figures, of which.

DESCRIPTION OF PREFERRED EMBODIMENTS

Figure 1:
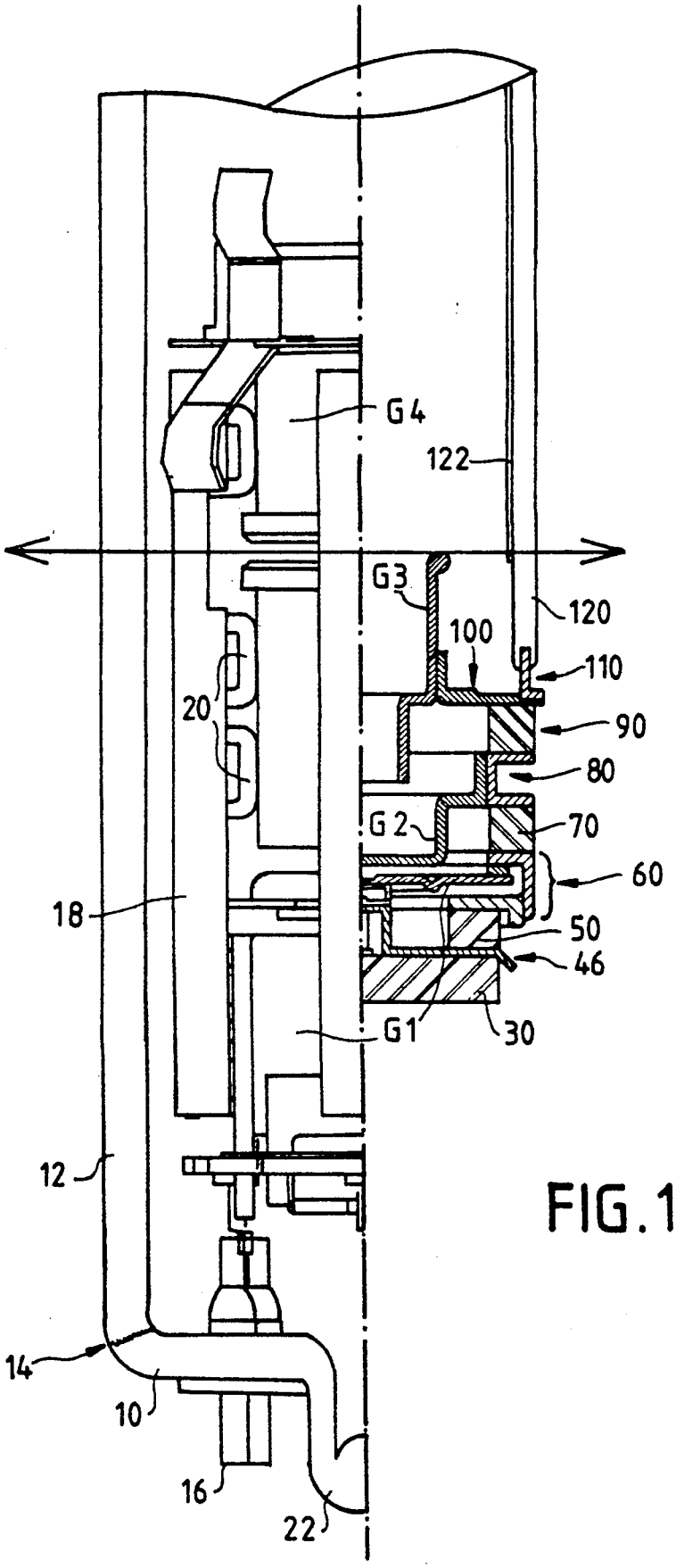
FIG. 1 shows a prior art cathode-ray tube on the left, and a tube according to the invention on the right.

FIG. 1 shall not be described in greater detail: it is a combined depiction of both a prior art cathode-ray tube and a tube according to the invention. These two tubes essentially have a circular symmetry around the vertical axis represented by a line of dots and dashes at the center of the figure, but the part to the left of the axis represents the prior art tube while the part to the right of the axis represents a tube according to the invention. The left-hand part of the figure (prior art) has already been described with its drawbacks. The right-hand part shows the construction, according to the invention, using the same scale so that the advantages obtained in terms of widthwise and lengthwise bulk can be measured. The improvement is considerable. We shall return further below to the various advantages resulting from this reduced bulk.

The references of the main elements are recalled in the right-hand part of FIG. 1. These elements shall now be described in detail with reference to FIG. 2.

Figure 2:
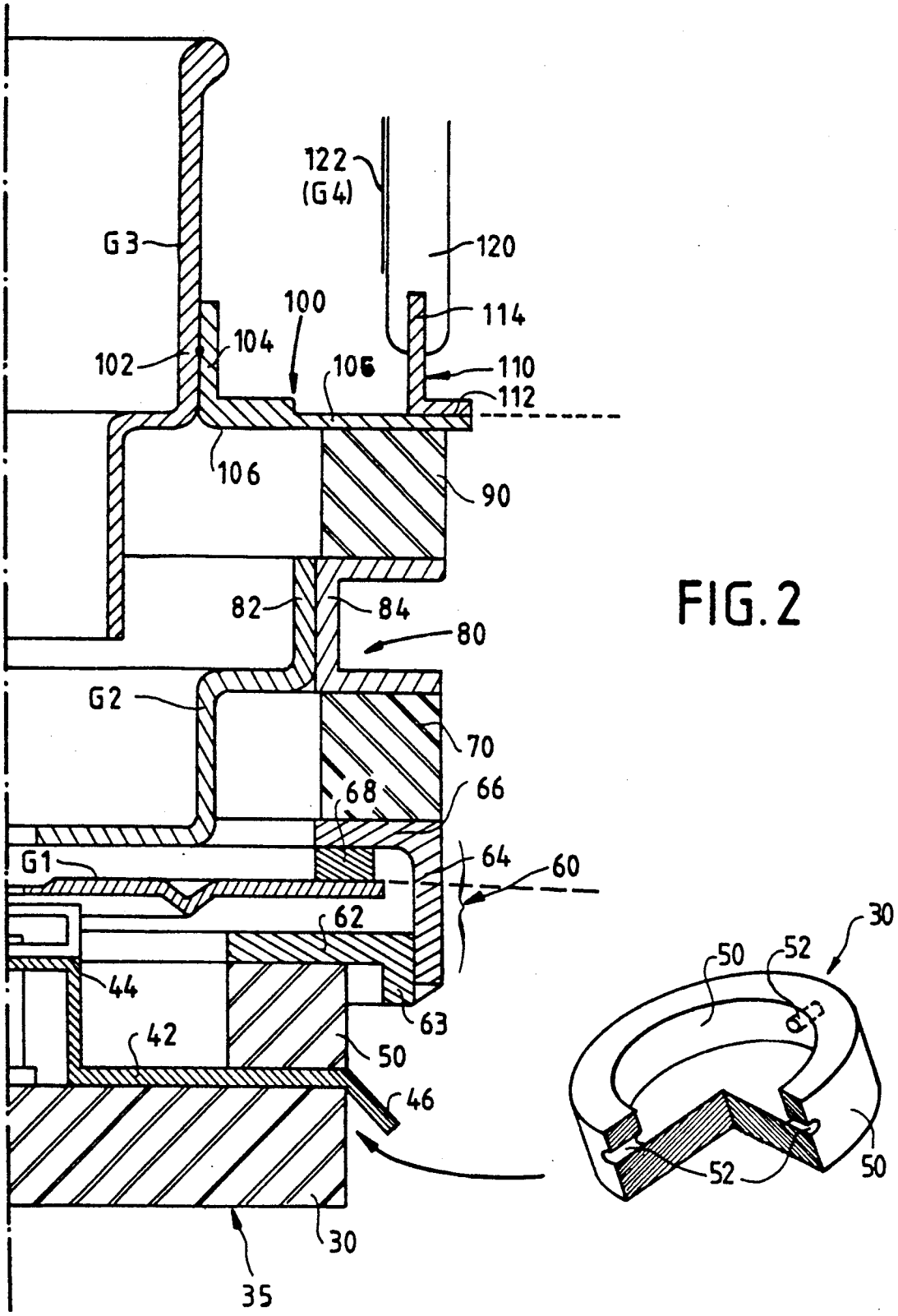
FIG. 2 shows an enlarged view of the detail of the construction of the stem and neck of the tube according to the invention.

FIG. 2 shows a detailed view of the construction according to the invention, in a particular example of application which is a cathode-ray tube having a cathode, three grids taken to different potentials in front of the electron gun, a fourth electrode formed by a graphite layer deposited inside the neck and the cone of the tube, and an anode formed by a display screen on the front face of the tube.

As in FIG. 1, only the base and the neck of the tube are shown, but not the cone or the front face.

FIG. 2 represents only the right-hand half of the tube, but it must be understood that (just as in FIG. 1 too) the tube has a symmetry of revolution around the axis shown by a line of dashes.

The base of the tube is a bowl-shaped, solid ceramic washer 30, the flat bottom of which forms the rear face of the tube, and the concavity of which is pointed towards the front of the tube. The rear face or bottom 35 of the washer 30 is not drilled with passages for outgoing electrical connections. However, the lateral edges 50 are drilled with passages 52 for the connection of the cathode and of the heating filament of the cathode.

To make it easier to understand its shape, this washer has been shown in a cutaway perspective in FIG. 2, alongside the corresponding sectional view.

In the main sectional view of FIG. 2, a cathode connection 42 is seen. This cathode connection 42 connects a cathode 44 to an external terminal 46. Similar connections, not seen in the section of FIG. 2, connect a heating filament to terminals external to the tube, through the lateral drillings 52 of the edges of the washer 30.

The ceramic used for all the parts of the tube will be, in principle, sintered aluminium.

As a rule, the metallic rings which have to be brazed to the ceramic are made of stainless steel with thermal expansion characteristics matching those of the ceramic. Stainless steels such as this are well known and commonly used when parts associating metal and ceramic are needed.

In the rest of the description, we shall speak of the rear face for a face pointed towards the screen side of the tube (i.e. facing the direction of movement of the electron beam emitted by the electron gun).

A control grid supporting metallic ring, bearing the general reference 60, is brazed to the front face of the ceramic washer 30. This ring is designed to support a control grid G1, placed in the immediate vicinity of the cathode and having to be taken to a potential that is different from the potential of the cathode.

For reasons related to ease of fabrication, given the fact that the grid G1 has to be kept very close to the cathode, the supporting ring 60 of the control grid G1 is made in three parts (in this example), and an explanation shall be given further below of how these parts are actually assembled to one another at different times in the overall assembly of the electron gun.

The first part of the ring 60 is a ring 62 having an annular plane part brazed to the front face of the edges 50 of the ceramic washer 30, and a cylindrical part 63, surrounding the plane part on the side radially outside it. It will be seen that this part is a constituent element of the cathode filament unit, and that it is only later soldered to the rest of the gun.

The second part of the metallic ring 60 is a ring 64 having, firstly, a cylindrical part surrounding the cylindrical part of the element 62 and soldered to it (when the gun is finished) and, secondly, a plane annular part 66, extending radially within the cylindrical part.

The third part is a metallic spacer 68 soldered to the rear of the plane annular part 66. The grid G1 is soldered to this spacer 68.

The outgoing electrical connection of the grid G1 is done by the external surface of the part 64.

A ceramic ring 70, having two plane annular faces, is brazed by its rear face to the front face of the annular part 66 of the part 64.

The imperviousness of the passage of the outgoing connection of the control grid G1 is provided by the brazing of the part 62 to the edges 50 of the ceramic washer 30, by the brazing of the part 64 to the ceramic part 70, and by an impervious soldering (preferablY a continuous laser soldering) between the parts 62 and 64 of the ring 60.

A second metallic ring 80 acts as a support and electrical connection for an acceleration grid G2.

The grid G2 is a ring-shaped grid having an external cylindrical wall 82 soldered peripherally to an internal, corresponding wall 84 of the ring 80.

The metallic ring 80 preferably has a U-shaped section pointed outwards from the tube, the bottom of the U forming the internal wall soldered to the grid G2, one side wall of the U being brazed to the front face of the annular ceramic part 70. The other side wall of the U is brazed to a last ceramic ring 90.

The electrical connection of the grid G2, towards the exterior of the tube, is made on the ring 80, outside it.

The imperviousness of the passage of this connection from inside to the exterior is provided, on one side, by the brazing with the ceramic ring 70 and, on the other side, by the brazing with the ceramic ring 90.

The ceramic ring 90 is similar to the ring 70 and to the ring 50. It has two plane, annular faces, the rear face being brazed to the metallic ring 80, and the front face being brazed to a metallic ring 100 for the support and electrical connection of a focusing grid G3.

The grid G3 is similar to the grid G2 and is placed in front of it. It is ring-shaped with a cylindrical wall 102, the external surface of which is soldered to the corresponding internal surface of a cylindrical wall 104 which forms a part of the ring 100.

The ring 100 includes, in addition to this cylindrical wall 104, a plane annular part 106 extending radially outwards of the tube. It is this annular part 106 that is brazed by its rear face to the front face of the last ceramic ring 90.

On the front face of the plane annular part 106 of the ring 100, another metallic ring 110 is soldered, by an impervious soldering, for example a continuous laser soldering (done at the end of fabrication). The ring 110 includes a plane annular part 112 soldered to the front face of the ring 100 and a cylindrical wall 114. The end of the cylindrical wall 114 is soldered, by a glass-metal soldering, to a glass envelope portion 120 of the tube. This portion forms a frontward extension of the stack of alternating ceramic rings and metallic rings, which forms the main body of the neck of the tube according to the invention.

The imperviousness at the passage of the focusing grid G connection is thus formed by the ceramic-metal brazing between the ring 100 and the ceramic 90, by the impervious soldering between the rings 100 and 110 and, finally, by the glass-metal solder between the part 110 and the glass tube 120.

The part 110 is made of a stainless steel chosen for its compatibility with a glass-metal solder. Appropriate stainless steels are well known and widely used in this field.

The neck of the tube according to the invention is thus formed by association between a portion of glass envelope and the stack of metallic rings and ceramic rings which has just been described.

It will be seen in FIG. 2 that a graphite layer 122 has been shown on the internal wall of the tube 120. This layer forms another part (G4) of the focusing electrode.

The pumping of the tube is done by a pip (not shown) located on the glass tube 120 in the cone (not shown).

For the fabrication of the tube, the following procedure will be preferably used: the following elements of the alternating stack of metallic rings and ceramic rings are assembled by soldering and brazing: ring 100, ring 90, ring 80, ring 70, parts 64 and 68 of the ring 60.

The grid G2 is then soldered to the ring 80 (and here the distance between the grid G2 and the grid G1 ca be adjusted at will by making the grid slide along the cylindrical part 84 of the ring 80).

Then, the grid G3 is soldered to the cylindrical wall of the ring 100 and, here again, the distance between the grids G2 and G3 can be adjusted by making the grid G3 slide to the desired height.

Finally, the grid G1 is soldered to the part 68.

Besides, the rear part of the tube is prepared as follows: the first part 62 of the metallic ring 60 is brazed to the ceramic washer 30, the connections are passed through and the unit formed by the cathode 44 and the heating element is fixed in position.

The parts 62 and 64 of the ring 60 are soldered together by a peripheral laser soldering, thus fixedly joining the two parts of the stack.

Furthermore, the front part of the tube is prepared: the cone is ended in front by a screen and ended in the rear by a beginning of the glass neck 120 (a pumping pip being formed in the cone), with getter inside the cone. By a glass-metal soldering, the part 114 of the ring 110 is soldered to the rear end of the glass neck 120. Then, the screen is fixed to the front of the cone. Finally, by means of a peripheral laser soldering, the metallic ring 110 ending the glass cone at the rear, and the metallic ring 100 ending the full assembly of the electron gun with all its electrodes at the front, are soldered together.

As compared with prior art tubes, it is seen that all the glass bars and metallic points buried in these bars have been removed. The gain in diameter of the tube is high. This is all the truer as the bars are generally thick enough for them not to be embrittled by the points.

Since the energy needed to supply the electromagnetic deflection coils (located around the neck of the tube) is all the greater as the diameter is big, there is a gain not only in the space occupied but, simultaneously, also in the consumption of the tube.

The base of the tube no longer includes any passages other than lateral ones for the connection terminals. It no longer consists of anything but a ceramic disk. A great deal is thus gained on the lengthwise space factor, and this is important in certain applications (for example, head-up visors for helicopters).

The construction is sturdy, and all the centering and holding springs, which are no longer needed, have been got rid of. This unit is highly resistant to vibrations, since the elements are all fixedly joined to one another.

The entire electron gun (cathode and different electrodes) mounted on its shielding case formed by the stack of alternating rings of ceramic and metal, is assembled with the glass tube, not by a torch soldering operation (glass on glass) as in the prior art, but by a laser soldering between the metallic rings 100 and 110. The result thereof is that no particles are created in the tube during assembly whereas, in the past, the soldering of the stem to the neck created glass particles in the tube.

The tube according to the invention also prevents the production, in the tube, of graphite particles due to friction by springs, during assembly, on the graphite layer forming the electrode G4.

Finally, the invention prevents the risks of pollution of the tube or screen which existed in the prior art during the operation for soldering the stem to the neck. This pollution came from the water vapor and from other products of the combustion of the soldering torch. In the tube according to the invention, the high-temperature soldering or brazing operations are performed without the cathode or screen of the tube being present, and the final assembly, when the cathode and the screen are present, can be done at a temperature which is practically the ambient temperature (laser soldering).

Through the invention, the following performance characteristics can be obtained, by way of example:

effective diameter: 65 mm;

diameter of the neck: 14 mm;

length: 93 mm;

luminance of the trace: 65000 candelas/$m^2$ for a spot diameter of less than 0.2 mm.;

energy of deflection of the beam: 300 microjoules.

What is claimed is:

1. An electron tube comprising:

a neck including a first subassembly formed by a stack of supporting metallic rings and ceramic rings brazed together, among which several specific metallic rings are used for the supporting of and the electrical connection to different internal electrodes of the tube, said internal electrodes being distinct from specific rings, the ceramic rings being used for the electrical insulation and physical separation of the metallic rings, wherein said neck comprises at least another subassembly of alternating stacked metallic rings and ceramic rings;

each subassembly is terminated at one end by a respective end metallic ring, said respective end metallic rings being soldered together by electrical or laser soldering; and the specific metallic rings of said first subassembly are shaped in such a way that said internal electrodes may be soldered to said rings by electrical or laser soldering after the stacked rings of the subassembly have been brazed together.

2. An electron tube according to claim 1, wherein the metallic rings are brazed to the ceramic rings to provide vacuum tightness, and wherein the metallic rings have a part internal to the tube used as a support to an electrode and an external part to be used for an outgoing electrical connection.

3. An electron tube according to claim 1, further comprising a base formed by a ceramic washer without axial drillings to provide the electrical connection with the electrodes of the tube, the external connections being made directly at the periphery of the neck by contact with the metallic rings.

4. An electron tube according to claim 3, wherein the ceramic washer is bowl-shaped, with a concave side pointed towards a front end of the tube, and a bottom side forming a rear end of the tube, and wherein lateral edges of the ceramic washer are provided with lateral drillings for cathode connections to pass through.

5. An electron tube according to one of the claims 1, 2, 3 or 4 wherein, to ensure the holding and connection of an electrode in the form of a cylindrical ring, one of the supporting metallic rings will have, firstly, a cylindrical part coaxial with the axis of the neck, the internal surface of which is soldered to a cylindrical external surface of the electrode and, secondly, a plane annular part extending in a plane that is perpendicular to the axis of the neck and concentric with it, said plane annular part extending from the axial cylindrical part up to the exterior of the neck, and being brazed to a plane annular surface of one of the ceramic rings.

6. An electron tube according to claim 1, wherein:

the tube has a base formed by a bowl-shaped ceramic washer, a first metallic ring supporting a first grid of the tube and being used for its outgoing connection is brazed to the ceramic washer; a ceramic ring brazed to the first metallic ring separates it from a second metallic ring; the second metallic ring is used for the support and connection of a second grid of the tube; another ceramic ring insulates the second metallic ring from a third metallic ring used for the support and for the connection of a third grid of the tube; finally, the tube includes glass parts to which the third metallic ring is soldered by a glass-metal solder.

7. A tube according to one of claims 1, 2, 3 or 4, wherein certain metallic rings are formed by an assembly of several parts soldered to one another.

8. A method for the fabrication of an electron tube, comprising the following operations;

making a stack of alternating ceramic rings and metallic rings;

brazing the ceramic rings to the metallic rings to constitute a wall having traversing metallic connections; and soldering each of several electrodes to a respective metallic ring by electrical or laser soldering to constitute a subassembly of precisely positioned electrodes connected to said traversing metallic connections.

9. A method of fabrication according to claim 8 comprising the following operations:

making a first set comprising at least one ceramic ring brazed to a metallic ring;

making a second set comprising a stack of ceramic rings brazed to metallic rings interposed between these ceramic rings and terminated by an end metallic ring;

mounting a cathode in the first set;

soldering at least one grid, by electrical or laser soldering, to a metallic ring of the second set;

soldering, by electrical or laser soldering, said metallic ring of the first set to said end metallic ring of the second set so as to achieve a vacuum-tight, fixed joining of the two sets respectively bearing the cathode and the grid.

* * * * *